United States Patent [19]

Grundy

[11] 4,368,862

[45] Jan. 18, 1983

[54] FAIL-SAFE MAGNETIC SENSING ARRANGEMENT

[75] Inventor: Reed H. Grundy, Murrysville, Pa.

[73] Assignee: American Standard Inc., Swissvale, Pa.

[21] Appl. No.: 219,282

[22] Filed: Dec. 22, 1980

[51] Int. Cl.[3] ..... B61L 1/16; B61L 21/00

[52] U.S. Cl. ..... 246/28 R; 340/47

[58] Field of Search ..... 246/28 R, 28 K, 34 D, 246/63 R, 194, 249; 340/47, 551

[56] References Cited

U.S. PATENT DOCUMENTS

| | | | |
|---|---|---|---|
| 2,966,582 | 12/1960 | Wachtel | 340/47 |
| 3,108,771 | 10/1963 | Pelino et al. | 246/28 R |
| 3,396,271 | 8/1968 | Gallagher . | |
| 3,408,493 | 10/1968 | Westover et al. | 246/249 |
| 3,588,686 | 6/1971 | Lingmann et al. . | |
| 3,964,703 | 6/1976 | Wilkas et al. | 246/34 D |

FOREIGN PATENT DOCUMENTS

| | | | |
|---|---|---|---|
| 1273559 | 7/1968 | Fed. Rep. of Germany | 246/28 R |

*Primary Examiner*—Thomas A. Robinson
*Attorney, Agent, or Firm*—J. B. Sotak

[57] ABSTRACT

A fail-safe magnetic sensing arrangement including a first and a second object relatively movable in relationship to each other. The first object includes a magnetic structure having a permanent magnet and a pair of pole pieces to develop a magnetic field. The second object includes an a.c. oscillator which is coupled to an amplifier by a saturable reactor transformer and the amplifier feeds a negative d.c. maker which normally energizes a relay except when the saturable reactor transformer is saturated by the magnetic structure which signifies that the second object is in the vicinity of the first object.

8 Claims, 3 Drawing Figures

FAIL-SAFE MAGNETIC SENSING ARRANGEMENT

FIELD OF THE INVENTION

This invention relates to a vital type of magnetic sensor and more particularly to a fail-safe detecting arrangement utilizing a permanent magnetic structure which saturates a saturable reactor for decoupling a source of a.c. oscillations from an output amplifier so that d.c. voltage is removed from an electromagnetic relay to indicate the presence of the saturable reactor.

BACKGROUND OF THE INVENTION

It will be appreciated that there are many electronic and/or electromagnetic devices for detecting or sensing the presence of objects moving along a predetermined path but these former arrangements are possessed of various shortcomings which restrict their usage only to ideally controlled environmental surroundings. However, in railway and mass and/or rapid transit operations, the sensors or detectors must be capable of properly functioning under extreme vibration, varying climatic conditions, drastic electrical effects, and vigorous physical abuse. Further, in various applications, such as vehicle detection, check-in/check-out operation, inductive train stop, and cut-in train control, it is mandatory that the apparatus functions in a fail-safe manner. In addition, it is necessary that the detecting arrangement not only must be rugged in construction but also must be simple, economical, and lightweight yet reliable in operation.

OBJECTS OF THE INVENTION

Accordingly, it is an object of this invention to provide a new and improved detecting arrangement which is capable of functioning satisfactorily in an adverse milieu.

A further object of this invention is to provide a fail-safe detector which utilizes a saturable reactor circuit to sense the presence of a permanent magnet structure.

Another object of this invention is to provide a vital type of sensing apparatus which employs a permanent magnet structure to saturate a saturable reactor to decouple an electronic oscillator from an amplifying circuit.

Yet a further object of this invention is to provide a fail-safe sensing arrangement comprising, first and second devices movable relative to each other, the first device including a permanent magnet structure, the second device including an electronic circuit having an input means for producing a.c. signals, a saturable means coupled to the input means, and an output means coupled to said saturable means whereby the a.c. signals are normally coupled from the input means to the output means except when the saturable means is saturated by said permanent magnet structure thereby indicating that the first device is in the vicinity of the second device.

Yet another object of this invention is to provide a novel fail-safe sensor which is economical in cost, unique in design, efficient in operation, dependable in service, durable in use, and easy to manufacture.

SUMMARY OF THE INVENTION

In accordance with the present invention, there is provided a fail-safe detecting arrangement for sensing the presence of a moving railway vehicle when it passes a given point along the wayside trackway. A magnetic structure includes a permanent ceramic magnet which is sandwiched between a pair of elongated soft iron pole pieces to propagate magnetic lines of flux upwardly toward a passing vehicle. The permanent magnet structure is diagonally disposed and fixedly attached to one of the rails of the trackway. The vehicle carries an electronic circuit including an oscillator, a saturable reactor transformer, an amplifier, a negative d.c. maker and an electromagnetic relay. The oscillator produces a.c. signals which are normally transformer coupled to the input of the amplifier. The amplified a.c. output signals are fed to the negative d.c. maker. The negative d.c. maker amplifies and rectifies the amplified a.c. signals to provide a negative d.c. voltage for energizing the electromagnetic relay for closing a front contact. Now when the railway vehicle reaches the given point, the magnetic field saturates the core of the transformer so that the a.c. signals are no longer transformer coupled to the input of the amplifier. Thus, the negative d.c. voltage ceases to be produced by the negative d.c. maker which in turn de-energizes the electromagnetic relay and results in the opening of the front contact which signifies that the railway vehicle is over the given point in the trackway.

BRIEF DESCRIPTION OF THE DRAWINGS

These objects and other attendant features and advantages will become more readily apparent as the invention becomes better understood by reference to the following detailed description when considered in conjunction with the accompanying drawings, in which:

Referring now to the drawings and in particular to FIG. 1, there is shown a railway vehicle detection arrangement for sensing the presence and/or passage of the vehicle V as it moves along a stretch of railway track including rail R. In practice, the track rail R provides the mounting support for the magnetic structure 1 which is the first device of the subject detecting arrangement. As shown in FIG. 3 the stationary structure 1 includes an elongated rectangular cross-sectional permanent magnet, such as a ceramic magnet 2, which is sandwiched between a pair of elongated soft iron pole pieces 3 and 4. The elongated pole pieces 3 and 4 are substantially identical and are tapered from the top to the bottom with the top terminating into two spaced enlarged pole faces 5 and 6. As shown, the flux lines of the magnetic field F emanate from pole face 5 into the air above the track rail R and recede into the pole face 6. It has been found that in train stop applications or the like, it may be advisable to incorporate an electromagnetic coil 7 about the ceramic magnet 2 and between pole pieces 3 and 4 as shown in FIG. 3. The purpose of the electromagnet 7 is to nullify and cancel the permanent flux field F, for example, in case an automatic train stop or vehicle detection is unnecessary or not required at any given wayside location at a particular time. In practice, the coil is energized by suitable wayside equipment to produce an electro-magnetic field which opposes the permanent magnet field F so that the structure 1 is rendered inert as will be described hereinafter. Preferably, the wayside magnetic structure is embedded in a suitable plastic compound, such as, a polyurethane potting material with a glass fiber reinforcement which not only produces a hermetic seal to protect the various components from moisture and foreign particles but also materially reduces the effects of external shock and vibrations on the internal components. It will be seen that the permanent magnet structure 1 is diagonally disposed relative to the longitudinal axis of the track rail R. The structure 1 is positioned along the side of rail R, and a pair of Z-shaped brackets 8 and 9 are attached to the flange portion of the rail R by suitable bolts or the like (not characterized).

The diagonally disposed wayside structural arrangement compensates for vehicle sway and permits some latitude in positioning the car-carried apparatus. That is, the car-borne reactive element may shift sideways so that the maximum number of flux lines cut through the saturable core 17 of the reactor transformer 12 which will be described hereinafter.

Figure 1:
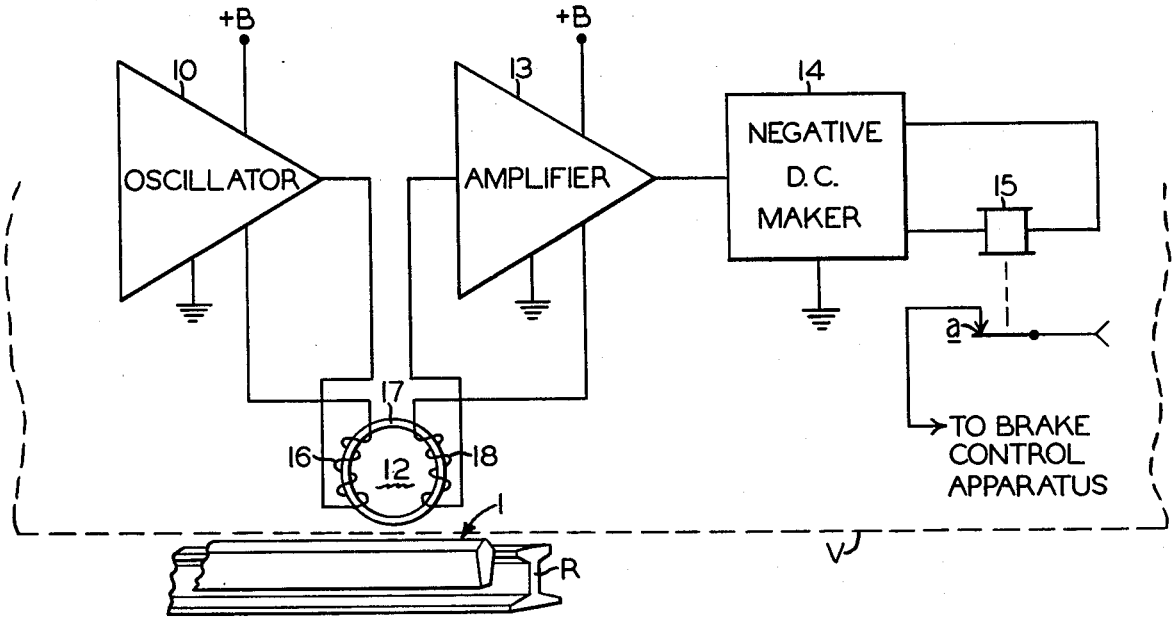
FIG. 1 is a schematic diagram illustrating the electrical components of one device and the magnetic structure of the other device shown in relation to a railway track of the subject invention.
Figure 2:
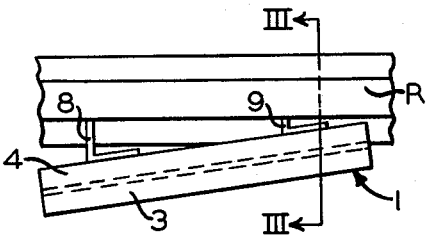
FIG. 2 is a top plan view of the magnetic structure as shown in relative position to a track rail.
Figure 3:
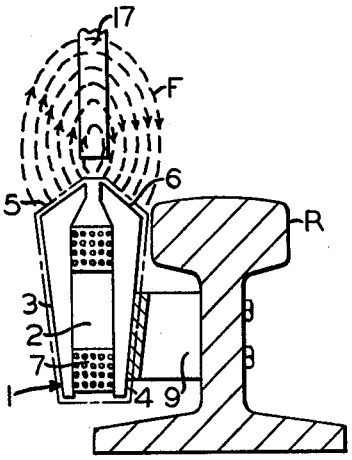
FIG. 3 is an enlarged cross-sectional view taken substantially along lines III—III of FIG. 2.

In viewing FIG. 1, it will be noted that the second device takes the form of a movable railway vehicle V which carries the active circuitry. The electrical circuit includes an electronic oscillator 10, a saturable reactor 12, an electronic amplifier 13, a negative d.c. maker 14 and an electromagnetic relay 15. The transistor or solid-state oscillator 10 produces a.c. signals which are conveyed to the input or primary winding 16 of the saturable reactor or transformer 12. The saturable transformer 12 includes an annular saturable core 17. The primary winding 16 as well as an output or secondary winding 18 are toroidally wound about the core 17. The secondary winding 18 is connected to the input of the transistor or solid-state amplifier 13. The output of the solid-state amplifying circuit 13 is connected to the input of the negative d.c. maker 14. The d.c. voltage maker may be of the type shown and disclosed in U.S. Pat. No. 3,527,986. Briefly, the negative d.c. voltage maker is a fail-safe circuit including an amplifier 9 and a rectifier 21 as illustrated in FIG. 2*a* of U.S. Pat. No. 3,527,986. The amplifier-rectifier circuit operates in a fail-safe manner in that no critical circuit or component failure is capable of increasing the gain characteristics of the circuit. Thus, the amplified a.c. oscillating signals received from amplifier 13 are amplified and rectified and are then applied to a vital type of relay 15. As shown, the negative output voltage of circuit 14 is connected to the coil of the relay 15. It will be appreciated that the electromagnetic relay 15 includes at least one contact, namely, front contact a which may control the circuit condition of the brake control apparatus of the vehicle or train. It will be seen that the front contact a is closed when the relay coil is energized by the negative d.c. making circuit 14 which energizes the emergency brake relay to hold the brakes in their released position. As will be described hereinafter, when the front contact a is opened by the de-energization of the relay 15, the brake control circuit is interrupted, and the brakes are applied to cause deceleration and stoppage of the passing vehicle or train.

In describing the operation, let us assume that the carborne circuitry is functioning properly, that the wayside magnetic structure is in place, but that the vehicle V is not in the vicinity of the magnetic structure 1. Under this condition, the transistor oscillator supplies a.c. signals to the primary winding 16 of the reactive transformer 12. The a.c. signals in the primary winding 16 are coupled by the magnetic core 17 to the secondary winding 18. Thus, a.c. signals are induced into the secondary winding 18 and are conveyed to the input of the transistor amplifier 13. The amplified a.c. signals are fed to the negative d.c. maker 14 which amplifies and rectifies the a.c. signals into a negative d.c. voltage. Thus, the d.c. output voltage energizes the electromagnetic relay 15 which closes the front contact a to complete the circuit to the brake control apparatus to preclude the application of the brakes.

Now let us assume that the approaching train reaches the area or vicinity of the permanent magnet structure 2. Hence, when the saturable reactor 12 enters the magnetic field F, the core 17 becomes saturated so that the a.c. signals in the primary winding 16 are decoupled from the secondary winding 18. That is, during saturation no a.c. signals are induced into winding 18, and no input signals are applied to amplifier 13. Thus, no a.c. input is fed to the d.c. maker 14, and no d.c. voltage is supplied to the coil of the relay 15. Hence, the relay 15 is de-energized which causes the opening of contact a. The opening of contact a results in the interruption of the circuit to the brake control apparatus so that the emergency brakes are applied to stop the train or transit vehicle.

It will be appreciated that if it is desirable to render the train stop ineffective, it is simply necessary to energize the coil 7 with the proper polarity of d.c. voltage which produces an electromagnetic field that opposes and negates the permanent magnetic field F. Thus, with the magnetic field effectively nullified, the core 17 is not saturated as it passes over the magnetic structure 1. Hence, the vehicle-carried circuitry remains unaffected as the vehicle V passes the train stop position. As previously mentioned, the presently described magnetic detector arrangement operates in a fail-safe manner in that no conceivable critical component or circuit failure is capable of falsely energizing the output relay 15. It will be apparent that the failure of the oscillator 10 causes the disappearance of the necessary a.c. signals. The opening of either coil 16 or 18 results in removal of the a.c. input to the amplifier 13. The shorting of turns of the coils and winding to winding is prevented by taking extra precautionary measures during construction of the saturable reactor. The negative d.c. maker is a fail-safe circuit and the use of negative d.c. voltage to energize the relay 15 ensures that a short from the relay coil to the positive +B supply voltage will not result in the energization of relay 15. Thus, it can be seen that the failures of either the active or passive elements are incapable of producing an unsafe condition.

It will be understood that while the presently described invention has been described and illustrated in relation to a train stop application, it is quite obvious that the invention has other usages, such as, vehicle detection, check-in/check-out, cut-in train control as well as other applications. But regardless of the manner in which this invention is used, it is apparent that various changes and modifications may be made by persons skilled in the art without departing from the spirit and scope of the present invention, and therefore it is understood that all variations, alterations, and equivalents are herein meant to be included in the appended claims.

Having thus described the invention, what I claim as new and desire to secure by Letters Patent, is:

1. A fail-safe sensing arrangement comprising, first and second devices movable relative to each other, said first device including a permanent magnet structure, said second device including an electronic circuit having an input means for producing a.c. signals, a saturable means coupled to said input means, and an output means coupled to said saturable means whereby said a.c. signals are normally transformer coupled from said input means to said output means by said saturable means except when said saturable means is saturated by said permanent magnet structure so that said input means and said a.c. signals are decoupled from said output means which signifies that said second device is in the vicinity of said first device.

2. The fail-safe sensing arrangement as defined in claim 1, wherein said permanent magnet structure includes a ceramic magnet and a pair of pole pieces.

3. The fail-safe sensing arrangement as defined in claim 2, wherein said permanent magnetic structure includes an energizable electromagnetic winding having a flux field which opposes the flux field of said ceramic magnet.

4. The fail-safe sensing arrangement as defined in claim 1, said input means including an oscillator circuit.

5. The fail-safe sensing arrangement as defined in claim 1 wherein said saturable means includes an annular core and a pair of windings.

6. The fail-safe sensing arrangement as defined in claim 1, wherein said output means includes an amplifying circuit, a d.c. making circuit and an electro-magnetic relay.

7. The fail-safe sensing arrangement as defined in claim 1, said first device is being disposed adjacent a track rail and said second device being carried on board a railway vehicle.

8. The fail-safe sensing arrangement as defined in claim 1, wherein said permanent magnet structure is an elongated member which is diagonally disposed in relationship to the longitudinal axis of a track rail.

* * * * *

UNITED STATES PATENT AND TRADEMARK OFFICE

CERTIFICATE OF CORRECTION

PATENT NO. : 4,368,862

DATED : January 18, 1983

INVENTOR(S) : Reed H. Grundy

It is certified that error appears in the above-identified patent and that said Letters Patent are hereby corrected as shown below:

Column 6, line 13, delete "is"

Signed and Sealed this

*Twenty-first* Day of *June 1983*

[SEAL]

*Attest:*

DONALD J. QUIGG

*Attesting Officer*

*Acting Commissioner of Patents and Trademarks*